US008579215B2

(12) United States Patent
Zavoli et al.

(10) Patent No.: US 8,579,215 B2
(45) Date of Patent: Nov. 12, 2013

(54) DRIP IRRIGATION EMITTERS WITH MANUALLY ADJUSTABLE WATER DIRECTING STRUCTURE

(75) Inventors: Lucas Brandon Zavoli, Murrieta, CA (US); Daniel Hideo Fujii, Temecula, CA (US); Derek Conrad, Riverside, CA (US)

(73) Assignee: Zujii Tech LLC, Temecula, CA (US)

( * ) Notice: Subject to any disclaimer, the term of this patent is extended or adjusted under 35 U.S.C. 154(b) by 253 days.

(21) Appl. No.: 13/115,015

(22) Filed: May 24, 2011

(65) Prior Publication Data

US 2012/0097769 A1 Apr. 26, 2012

Related U.S. Application Data

(60) Provisional application No. 61/405,627, filed on Oct. 21, 2010.

(51) Int. Cl.
*B05B 15/00* (2006.01)

(52) U.S. Cl.
USPC ..... 239/542; 239/547

(58) Field of Classification Search
USPC ..... 239/542, 543, 546, 547, 548, 553.3, 239/553.5
See application file for complete search history.

(56) References Cited

U.S. PATENT DOCUMENTS

| | | | | |
|---|---|---|---|---|
| 1,492,941 | A * | 5/1924 | Sherman et al. | 239/120 |
| 3,503,554 | A * | 3/1970 | Clifton | 239/23 |
| 3,814,377 | A * | 6/1974 | Todd | 251/145 |
| 5,054,690 | A | 10/1991 | Olson | |
| 5,232,160 | A | 8/1993 | Hendrickson et al. | |
| 5,253,807 | A | 10/1993 | Newbegin | |
| 6,123,272 | A | 9/2000 | Havican et al. | |
| 6,827,298 | B2 | 12/2004 | Sacks | |
| 7,581,687 | B2 | 9/2009 | Feith et al. | |
| D624,156 | S | 9/2010 | Leber | |
| 2003/0192964 | A1 | 10/2003 | Foster et al. | |

(Continued)

FOREIGN PATENT DOCUMENTS

| | | |
|---|---|---|
| CN | 2319131 Y | 5/1999 |
| CN | 101743888 A | 6/2010 |
| GB | 1442718 | 7/1976 |

OTHER PUBLICATIONS

"DIG 06-504 Swivel Side Outlet Six-Outlet PC Emitter/Bubbler (4.5 gph)", Sprinker Warehouse, Inc., http://www.sprinklerwarehouse.com/6-Outlet-PC-Drip-Emitter-Bubbler-p/06-504.htm, printed from the Internet on Jun. 1, 2011.

(Continued)

*Primary Examiner* — Davis Hwu
(74) *Attorney, Agent, or Firm* — Chen Yoshimura LLP

(57) ABSTRACT

An emitter to be used for drip irrigation is described. It includes a base equipped with a plunger that can be inserted into a drip irrigation pipe. The base is shaped to hold a spherical rotating member. This rotating member is traversed by a conduit that direct the water flow from the plunger to a spout located on top of the rotating member. An annular cap screwed or snapped on top of the base holds the rotating member in place. The emitter can be mounted on an irrigation pipe by punching a hole in the pipe and inserting the plunger. The rotating member can be directed to the desired direction by slightly unscrewing the cap, adjusting the position of the rotating member and retightening the cap.

14 Claims, 7 Drawing Sheets

(56) References Cited

U.S. PATENT DOCUMENTS

| | | | |
|---|---|---|---|
| 2009/0051159 | A1 | 2/2009 | Cameron et al. |
| 2009/0320932 | A1 | 12/2009 | Giuffre' |
| 2010/0252127 | A1 | 10/2010 | Gross |

OTHER PUBLICATIONS

"Apollo 8 Manifold", Star Nursery, Inc., http://www.starnursery.com/apollo-8-manifold.html, printed from the Internet on Jun. 1, 2011.

Installation Instructions "Model A450 Four Zone Retrofit Drip System", DIG Corp., San Marcos, CA, 1996.

"Drip/Low Volume Irrigation Guide" from "Product Catalog 2006-2007", Ewing Irrigation Products, Inc., Phoenix, AZ.

"Drip Irrigation Emitters", Jess Stryker, http://www.irrigationtutorials.com/drip-emitter.htm, printed from the Internet on Apr. 18, 2011.

"Adjustable Emitters & Sprayers", Irrigation Direct, http://www.irrigationdirect.com/irrigation-products-and-supplies/drip-irrigation/drip-emitters/adjustable-emitters-sprayers, printed from the Internet on Apr. 18, 2011.

"Drippers and Drip Emitters", Drips Inc., http://www.mrdrip.com/drippers.htm, printed from the Internet on Apr. 18, 2011.

"Advantages & Benefits of Drip Irrigation", Irrigation Direct, http://www.irrigationdirect.com/expert-advice/drip-irrigation-tutorials, printed from the Internet on Apr. 18, 2011.

* cited by examiner

DRIP IRRIGATION EMITTERS WITH MANUALLY ADJUSTABLE WATER DIRECTING STRUCTURE

This application claims priority under 35 USC §119(e) from U.S. Provisional Patent Application No. 61/405,627, filed Oct. 21, 2010, which is herein incorporated by reference in its entirety.

BACKGROUND OF THE INVENTION

1. Field of the Invention

This invention relates to sprinkler heads and drip irrigation emitters. More particularly, it relates to sprinkler heads and emitters capable of being manually directed to project water toward any desired direction, and sprinkler heads and emitters that can emit water in multiple directions simultaneously.

2. Description of the Related Art

In drip irrigation, water is distributed at point locations throughout a field and is slowly and efficiently released and directed toward the roots of plants. The advent of plastic pipes made such a watering system economical to install. The installation of an emitter is a simple procedure. Essentially a plastic watering pipe is laid out in a field. Holes are punched into the pipe and emitters are installed by inserting into the hole a plunger located at the base of the emitter. The pipe itself serves as the physical support for the emitter. Typically a multiplicity of such emitters is mounted on a single pipe.

Many emitters have been patented. These include U.S. Pat. No. 4,2121,771 by Hendrickson, U.S. Pat. No. 4,143,820 by Bright, Sr., U.S. Pat. No. 4,226,368 by Hunter, U.S. Pat. No. 4,281,798 by Lemelstrich, U.S. Pat. No. 4,533,083 by Tucker, U.S. Pat. No. 4,722,481 by Lemkin, U.S. Pat. No. 4,850,531 by Littleton, U.S. Pat. No. 5,318,657 by Roberts, U.S. Pat. No. 6,015,102 by Daigle et al., and U.S. Pat. No. 6,250,571 by Cohen.

SUMMARY OF THE INVENTION

A problem arises when an emitter is not pointing in the right direction. Rotating the pipe on its axis is not a good solution because this action disturbs the orientation of all the other emitters along the pipe. However, none of above mentioned conventional emitters addresses this problem. In addition, conventional drip emitters are not configured to project water in any desired direction.

Accordingly, the present invention is directed to an emitter to be used for drip irrigation that substantially obviates one or more of the problems due to limitations and disadvantages of the related art.

An object of the present invention is to provide an emitter that can be easily adjusted manually to direct water in different directions.

Another object of the present invention is to provide an emitter that can emit water through two or more outlets simultaneously.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides an emitter for a drip irrigation system which includes: a base equipped with a plunger configured to be inserted into a drip irrigation pipe; a rotating member configured to fit onto said base and equipped with a spout, said spout being in fluid communication with said plunger thereby allowing water to flow from said plunger to said spout, said rotating member being manually rotatable thereby allowing said spout to be oriented in substantially any direction within a hemisphere.

In another aspect, the present invention provides an emitter for a drip irrigation system which includes: water inlet in fluid communication with a water supply; and a manually adjustable water directing structure in fluid communication with the water inlet, for directing water in a direction which is adjustable within a substantial portion of a hemisphere, the water directing structure having a spout with at least one water outlet, the water outlet being in fluid communication with the water inlet.

In yet another aspect, the present invention provides an emitter for a drip irrigation system which includes: a water inlet in fluid communication with a water supply; and a manually adjustable water directing structure in fluid communication with the water inlet for directing water in adjustable directions, the water directing structure having a spout with two or more water outlets in fluid communication with the water inlet, wherein the directions of the two or more outlets are manually adjustable around a rotational axis.

It is to be understood that both the foregoing general description and the following detailed description are exemplary and explanatory and are intended to provide further explanation of the invention as claimed.

DETAILED DESCRIPTION OF THE PREFERRED EMBODIMENTS

A first embodiment of the present invention provides an emitter to be used for drip irrigation, which allows water to be projected in substantially any direction within a hemisphere. It includes a base joined to a hollow plunger that can be inserted into a drip irrigation pipe. The base is indented on its top to hold an essentially spherical rotating member. This rotating member is traversed by a conduit that directs the water flow from the plunger to a spout located essentially on the top of the rotating member. An annular cap (retainer ring), screwed or snapped on top of the base, holds the rotating member in place. The usage of the device is simple. It is mounted on an irrigation pipe by punching a hole in the pipe and inserting the plunger. The rotating member can be directed toward the desired direction by slightly unscrewing the cap, adjusting the position of the rotating member and retightening the cap. Embodiments of the invention provide adjusting or rotating capabilities to drip emitters.

Figure 1:
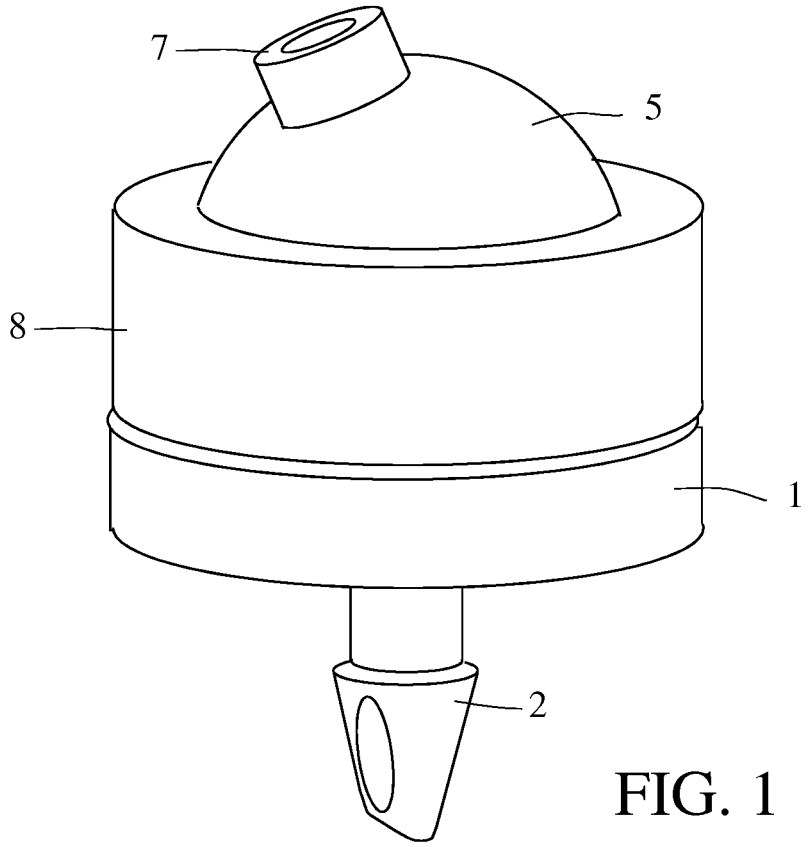
FIG. 1 illustrates an assembled emitter according to a first embodiment of the present invention.
Figure 2:
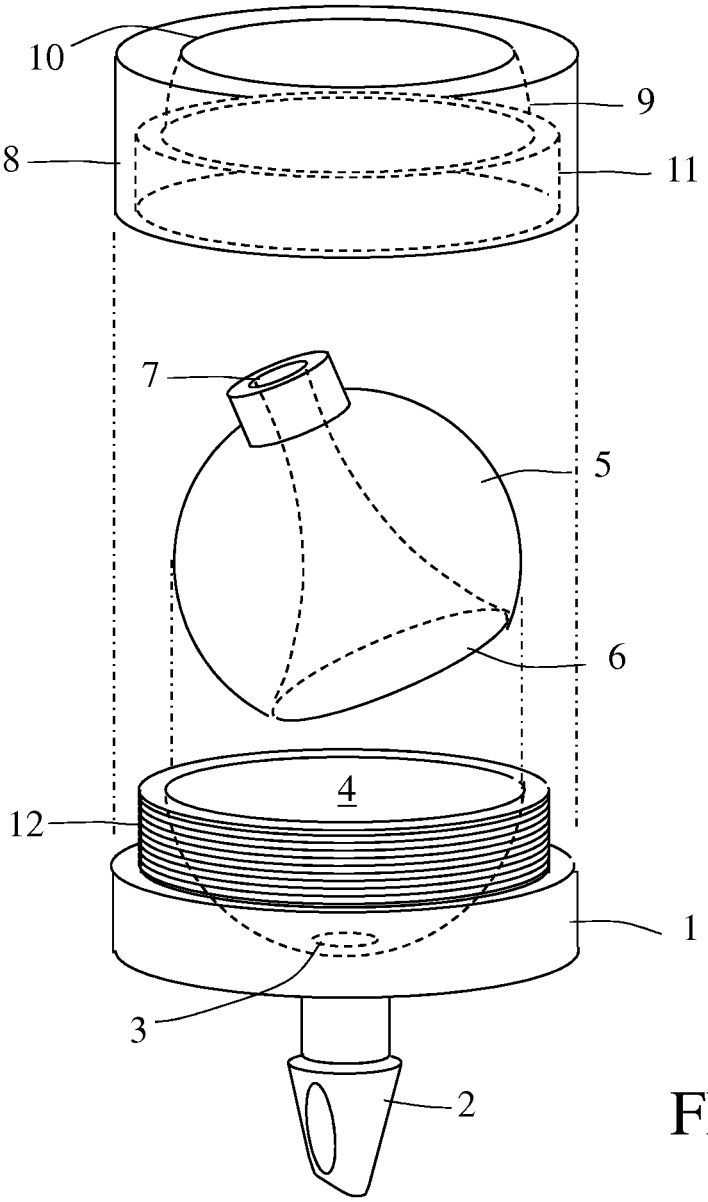
FIG. 2 is an exploded view of the emitter of FIG. 1 showing the base, the rotating member and the cap.
Figure 3:
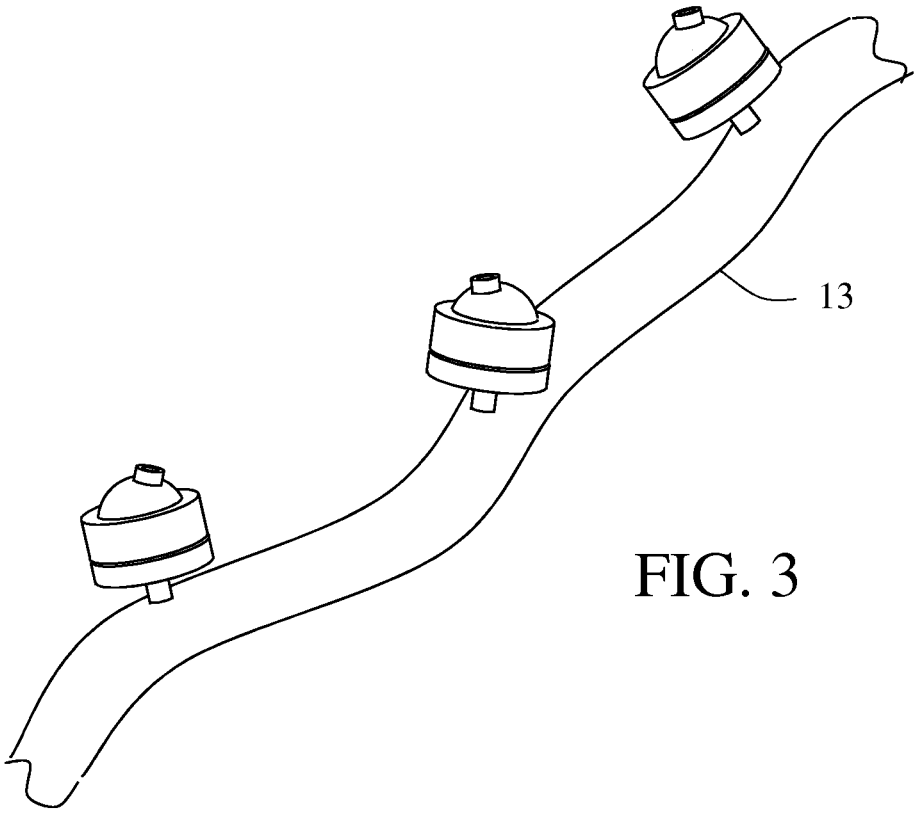
FIG. 3 illustrates the method of use of the emitter of FIG. 1, showing how the emitter can be adjusted to different direction according to the user's desire.

FIG. 1 shows the assembled emitter device according to the first embodiment, FIG. 2 provides an exploded view showing each individual parts and FIG. 3 shows how the device is used.

As shown in FIGS. 1 and 2, the emitter device comprises a base 1 joined at its bottom with a plunger 2. This plunger is hollow and configured to direct the water flow from its bottom tip to the top of the base. The top of the base includes an opening 3 that communicates with the hollow plunger 2. The top of the base also includes a spherical indentation 4.

The rotating member 5 is essentially spherical to smoothly rotate inside the spherical indentation 4 at the top of the base 1. The bottom of the rotating member includes an opening 6 large enough to allow water flow no matter how the rotating member 5 is oriented. A hollow interior space traverses the rotating member 5 from the opening 6 and tapering off into a narrow conduit exiting through a spout 7 configured at the top of the rotating member 5. Thus the spout is in fluid communication with the plunger.

The rotating member 5 is held in place by an annular cap (retainer ring) 8, which includes at its bottom a spherical indentation 9 configured to match the sphericity of the rotating member. This cap 8 has at its top an opening 10 with a diameter smaller than the diameter of the rotating member to insure that the rotating member 5 does not slip through it when water pressure is applied.

The cap 8 also includes at its bottom a female thread 11 matching a male thread 12 configured at the top of the base 1.

Assembly of the device is simple. The rotating member 5 is positioned inside the base 1 and the cap 8 is screwed on top to hold the rotating member 5 in place.

To facilitate the tightening and untightening of the cap 8 from the base 1, the external cylindrical surface of the cap and of the base can be knurled, that is they can be imprinted with a relief pattern that increases friction with fingers.

The use of the device is simple. As shown in FIG. 3, a hole in the pipe 13 carrying water is punched and the device's plunger is inserted into the hole. The cap 8 is slightly unscrewed to loosen the rotating member 5, the rotating member 5 direction is adjusted as desired and the cap 8 is retightened to keep the spout 7 facing the proper direction. The pipe may be made of poly-tubing, PVC, etc.

It is clear to those versed in the art that this is one of many possible implementations of an emitter that can be manually adjusted to project water in any desired direction over a solid angle corresponding to substantially an entire hemisphere. Furthermore the spout can be configured to project water in different patterns. FIGS. 1, 2 and 3 illustrate a spout projecting water in a single stream, but it is possible as is well known in this industry, to project water in a line, in a spray, or in an arc spanning a predetermined angle, for example 90 degrees, 180 degrees, or 360 degrees. Different water patterns can be achieved by attaching various attachments to the spout, such as jet spray, multiple stream spray, fan type spray, mister, etc.

Furthermore, as is well known in this art, it is possible to incorporate into the base 1 or the rotating member 5, fluidic or mechanical implements that regulate the pressure of the water, or the amount of water leaving the spout 7. One example is a flow diaphragm, which can regulate water pressure to a desired amount of emitter water per hour, regardless of water pressure in the pipe 13. The diaphragm is preferably located in the base.

Figure 4A:
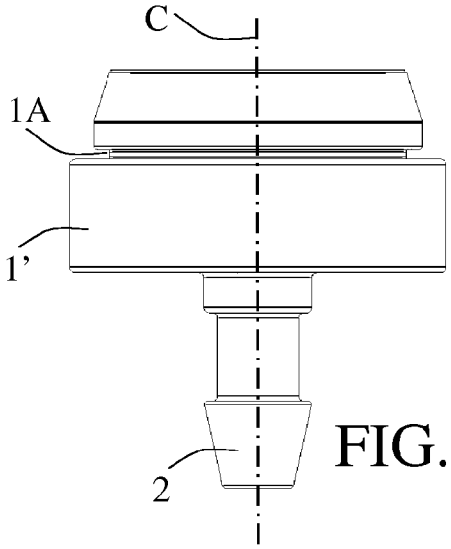
FIGS. 4A and 4B illustrate an alternative implementation of the first embodiment with a snap-on cap.
Figure 4B:
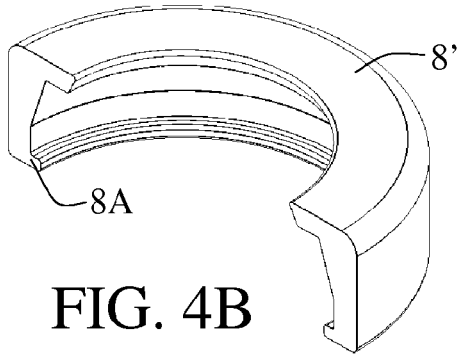

In an alternative implementation of the first embodiment, a snap fit is used, in lieu of threads 11 and 12, to affix the retainer ring to the base. FIG. 4A is a side view of the base 1' and plunger 2, and FIG. 4B is perspective cut-away view of the retainer ring 8' of this alternative implementation. The base 1' has a circular groove 1A on its outside (in lieu of thread 12 as shown in FIG. 2), and the retainer ring 8' has a circular lip 8A at the bottom of it that fits into the groove 1A when assembled. The base 1' and retainer ring 8' keeps sufficient but not overly strong pressure on the rotating member 5 to maintain its direction during irrigation use, while allowing the rotating member to be adjusted by a user by sliding it between the base and the retainer ring. The rotating member 5 is not shown in FIGS. 4A and 4B.

Figure 5A:
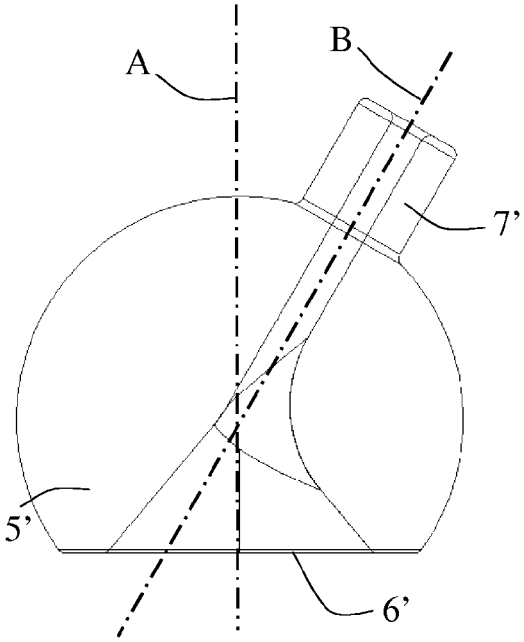
FIG. 5A illustrates another alternative implementation of the first embodiment with an offset spout.
Figure 5B:
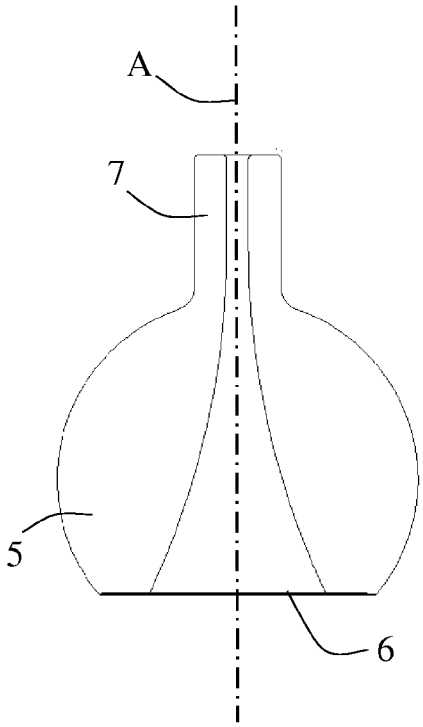
FIG. 5B illustrates an implementation of the first embodiment using a straight spout.

In an alternative implementation of the rotating member of the first embodiment, shown in FIG. 5A, the direction of the spout 7' of the rotating member 5', as indicated by the axis B, is offset by an angle with respect to a central axis A, which is perpendicular to a plane defined by the opening 6' at the bottom of the rotating member 5'. The offset angle may be, for example, approximately 15 degrees, or more generally, between 10 and 20 degrees. As a comparison, the rotating member 5 shown in FIG. 5B has a spout 7 which has a direction that coincides with the central axis A.

With the offset spout 7' shown in FIG. 5A, the rotating member 5' can achieve coverage of the same solid angle (which is substantially the entire hemisphere) with less rotation away from the rotational axis C of the base and the plunger (the rotational axis C is illustrated in FIG. 4A). For example, assuming the offset angle of the spout 7' is 15 degrees, to point the spout at a direction 60 degrees from the rotational axis C of the base, the central axis A of the rotating member 5' only needs to be oriented 45 degrees from the rotational axis C. (The angle between the central axis A and the rotational axis C of the base is referred to as the inclination angle.) To point the spout 7' in the direction of the rotational axis C, the central axis A is oriented 15 degrees in the opposite direction from the rotational axis C. The rotating member 5' can also be adjusted by rotating the spout 7' around the rotational axis of the base (i.e. changing its azimuth angle).

Because the maximum required inclination angle is now reduced, the opening 6' of the rotating member 5' can be smaller (as compared to the opening 6 in the implementation shown in FIG. 5B) yet still ensuring fluid communication with the top opening 3 of the base 1. A smaller opening 6' and a reduced maximum inclination angle help to prevent water leakage which can occur when the opening 6'/6 is not completely covered by the spherical indentations 4 and 9 of the base 1 and retainer ring 8 due to large inclination angles of the rotating member.

The direction and the elevation of the water jet can be adjusted thereby allowing the user to direct water in any direction, and reach varying distances. Changing the elevation of the jet can help in avoiding intervening bushes that may obstruct water distribution.

Figure 6A:
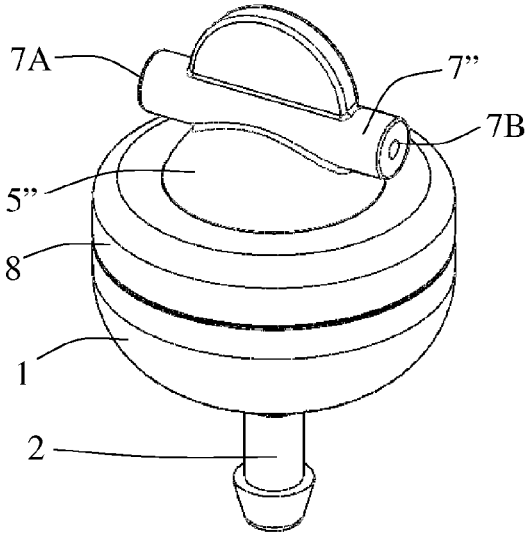
FIGS. 6A and 6B illustrate an emitter having a T-shaped spout according to a second embodiment of the present invention.
Figure 6B:
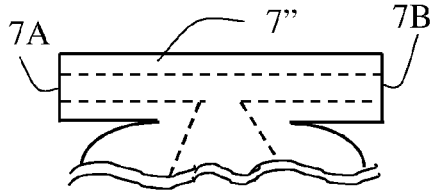

A second embodiment of the present invention is shown in FIGS. 6A-6B. Similar to the first embodiment shown in FIGS. 1-2, the emitter device has a base 1, a plunger 2, and a retainer ring (cap) 8. A rotating member 5" is located inside the base 1 and cap 8. The rotating member 5" is similar to the rotating member 5 of FIGS. 1-2 except for the spout 7". As shown in FIG. 6A (perspective exterior view of the emitter), the rotating member 5" of the emitter has a spout 7" with two outlets 7A and 7B, with a T-shaped water passage inside as schematically shown by the dashed lines in FIG. 6B (view of a part of the spout 7"). The vertical part of the T-shaped water passage is located at the top of the hollow interior space of the rotating member 5". The rotating member 5" with the spout 7" can be rotated (twisted) around the rotational axis C of the base (see FIG. 4A) to emit water in different directions; it can also be tilted slightly with respect to a plane perpendicular to the rotational axis C. The T-shaped spout 7" may be formed as one piece with the rotating member 5", or it may be formed as a T-shaped attachment that can be attached to a single spout 7 such as that shown in FIG. 1.

Figure 7A:
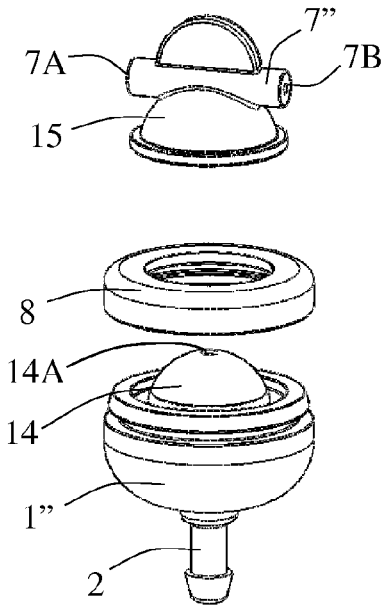
FIG. 7A is an exploded view illustrating an emitter having a T-shaped spout according to a third embodiment of the present invention.

An emitter according to a third embodiment of the present invention is shown in FIG. 7A. Similar to the second embodiment of FIG. 6A-6B, this emitter uses a T-shaped spout 7". As shown in FIG. 7 (exploded view), the base 1" has a spherical shaped protrusion 14 with a top opening 14A in fluid communication with the plunger (not shown). A spout cap 15 has a spherical shaped inside surface which fits over the protrusion 14. The spout cap 15 is held in place against the protrusion 14 by the retainer ring 8. The spout cap 15 has a T-shaped spout 7" with two outlets 7A and 7B. In this embodiment, the spout cap 15 can rotate around the rotational axis of the base 1" but does not tilt. The outer shape of the protrusion 14 and the inner shape of the spout cap 15 do not have to be spherical; any surfaces with a rotational symmetry may be used, including flat surfaces.

Figure 7B:
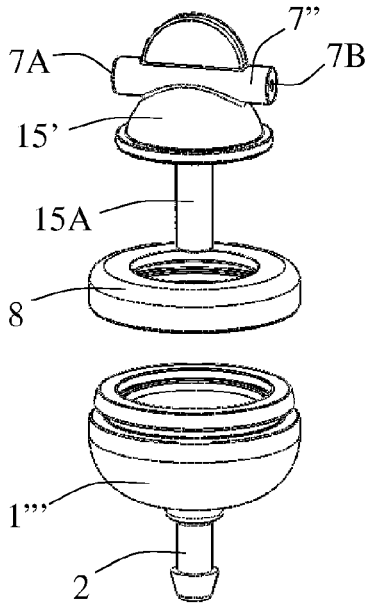
FIG. 7B is an exploded view illustrating an emitter having a T-shaped spout according to an alternative implementation of the third embodiment.

FIG. 7B illustrates an emitter according to an alternative implementation of the third embodiment. Similar to the emitter shown in FIG. 7A, the emitter shown in FIG. 7B has a T-shaped spout 7" with two outlets 7A and 7B. The spout 7" is a part of the spout cap 15'; the spout cap 15' also has a vertical tube 15A forming a T-shaped water channel (see FIG. 6B). The tube 15A fits into and is in fluid communication with the plunger 2. Water flows from the plunger 2 via the tube 15*a* to the two outlets 7A and 7B. The spout cap 15' is held between the base 1'" and the retaining ring 8, which can be loosened to allow the spout cap 15' to rotate.

A common feature of the second embodiment shown in FIGS. 6A-6B and the third embodiment shown in FIGS. 7A-7B is that the spout has two water outlets. The spout with two outlets is carried by a rotating piece (rotating member 5" in FIG. 6A or spout cap 15/15' in FIGS. 7A and 7B) which is rotatable with respect to the base. The rotating piece may be tilted slightly as in the embodiment of FIG. 6A, or it may be non-tiltable as in the embodiment of FIGS. 7A and 7B. Any suitable design can be used to couple the rotating piece to the base, so long as it provides the required fluid communication and allows the rotating piece to rotate around the rotational axis of the base. Some examples are shown in FIGS. 6A and 7A-7B, but other designed are also possible.

The spout 7" with two outlets shown in FIGS. 6A-7B allows the water to drip in two directions. While the spout 7" in FIGS. 6A-7B is T-shaped, i.e., the two outlets are in one line and point to opposite directions, the spout may also be Y-shaped, i.e., the two outlets are not in one line. Further, the spout may have more than two water outlets arranged in any suitable manner.

In the embodiments shown in FIGS. 1, 2, 6A and 7A-7B, the spouts 7/7'/7" is preferably designed for a user to grasp and twist the rotating member to adjust the destination of the emitter water. In addition, in the embodiments shown in FIGS. 7A-7B, a small piece of plastic is provided as a part of the spout 7" to serve as a small finger hold to make the twisting and adjusting of the rotating member easier. Finger holds may be added to the spouts 7/7'/7" of FIGS. 1, 2, 5A, 5B, 6A and 6B.

Figure 8A:
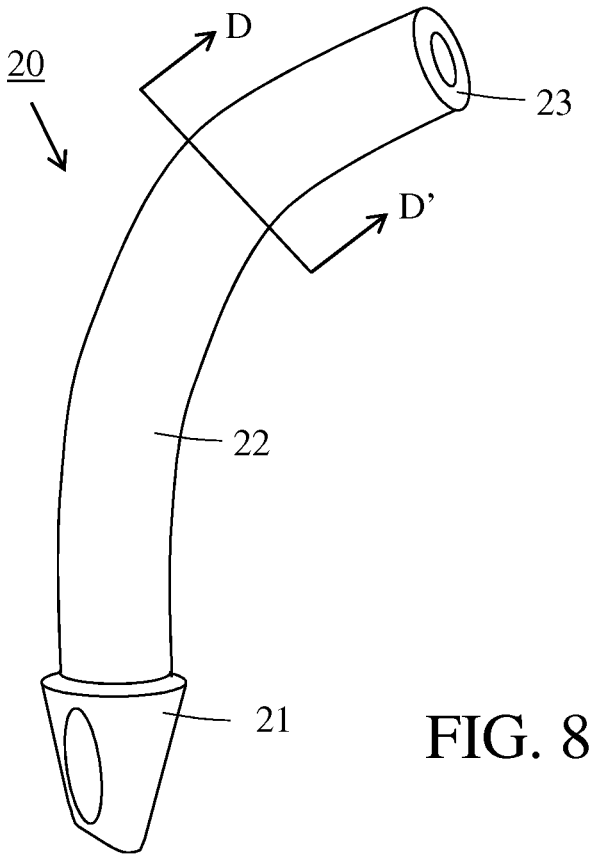
FIGS. 8A and 8B illustrate an emitter having a bendable tubular body according to a fourth embodiment of the present invention.
Figure 8B:
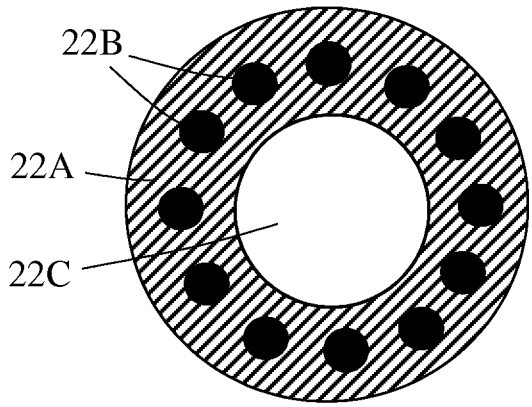

FIGS. 8A and 8B illustrate an emitter according to a fourth embodiment of the present invention. In this embodiment, the emitter 20 includes a plunger 21 for inserting into a hole of a water pipe, and a manually bendable tubular body 22 joined to the plunger 21. Similar to the plunger 2 shown in FIG. 1, the plunger 21 is hollow inside and configured to direct the water flow from its bottom tip (inserted into the water pipe) to its top which is in fluid communication with the hollow interior of the tubular body 22. The water is emitted from the top opening 23 of the body 22.

The tubular body 22 is constructed such that it is manually bendable (i.e., by hand without using a tool) and retains its bent shape without external support. FIG. 8B is cross-sectional view of the body 22 along the direction D-D' of FIG. 8A. The tubular body 22 is constructed of a flexible material 22A with a plurality of parallel wires 22B embedded inside the material 22A and extending parallel to the direction of the tube. The material 22A forms a tube wall enclosing a hollow space 22C which forms a water passage. The cross-sectional structure shown in FIG. 8B is the same along substantially the entire length of the tube body 22.

The tube wall material 22A is a flexible material such as rubber, plastic, etc., and the wires 22B are made of a suitable metal or other materials that can be bent and can retain its bent shape. The thickness of the wire is preferably chosen to allow for the tube 22 to be sufficient pliable so that it can be easily bent by hand, yet sufficient stiff so that it will retain its bent shape without external support.

In use, the plunger 21 is inserted into a hole in a water pipe (similar to that shown in FIG. 3), and the tubular body 22 is bent (e.g. by hand) so that the opening 23 is in a desired direction. The tubular body 22 will retain this position. Water flows from the plunger into the tubular body 22 and is emitted from the opening 23, which constitutes the outlet of the emitter.

Figure 9A:
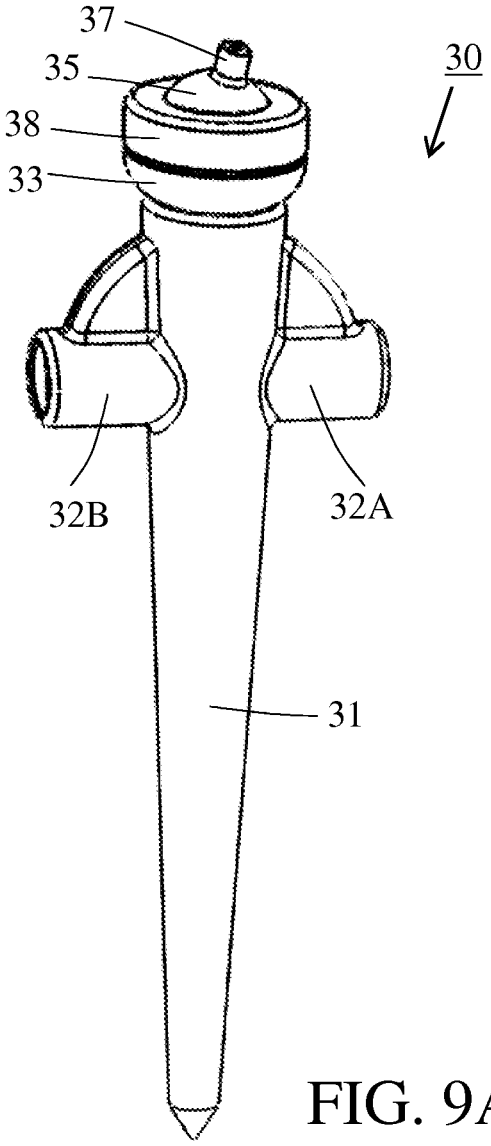
FIGS. 9A-9C illustrate an emitter in the form of a stake according to a fifth embodiment of the present invention.
Figure 9B:
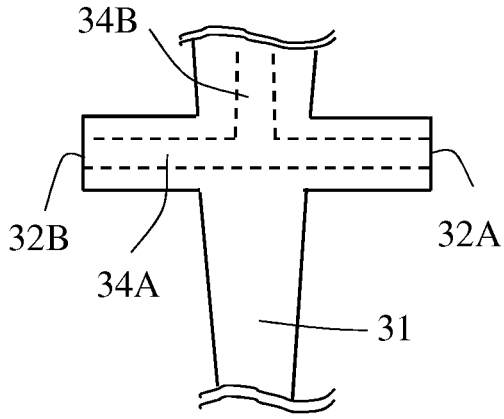

FIGS. 9A and 9B illustrate an emitter in the form of a stake according to a fifth embodiment of the present invention. As shown in FIG. 9A, the emitter stake 30 has a stake 31 with a pointed lower end so that the stake can be inserted into the ground. The stake 31 may have any suitable structure (hollow, solid) and any suitable cross-sectional shape, and may be made of plastic, metal, or other suitable materials. An emitter base 33, which may be similar to the base 1/1'/1"/1'" shown in FIGS. 1, 2, 4A, 6A and 7A-7B, is joined to the upper end of the stake 31.

Two short side tubes 32A and 32B are joined to and extend sideways from an upper-middle portion of the stake 31, and the hollow interiors of the side tubes 32A and 32B form a substantially horizontal water channel 34A (see FIG. 9B, schematic cross-sectional view). A substantially vertical water channel 34B inside the upper portion of the stage 31 fluidly connects the water channel 34A with a hollow interior space of the emitter base 33. Thus, a T-shaped water passage 34A and 34B fluidly connects the side tubes 32A and 32B to the emitter base 33.

The rotating member 35 with spout 37 may have a similar structure as the rotating members 5/5'/5"/15/15' with spout 7/7'/7" shown in FIGS. 1, 2, and 5A-7B. The retainer ring 38, which cooperates with the emitter base 33 to retain the emitter 35, may have a similar structure as the retainer ring 8/8' in FIGS. 1, 2, 4B, 6A and 7A-7B.

Figure 9C:
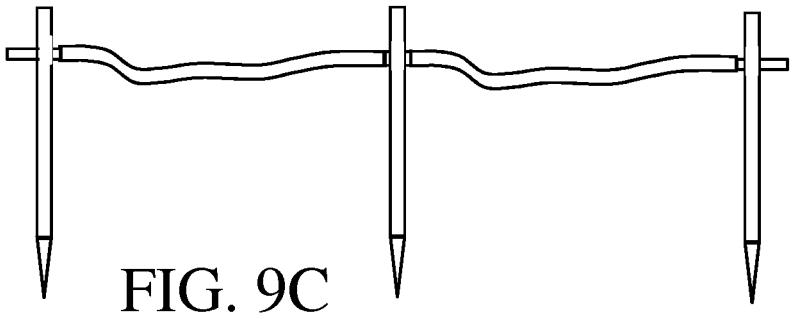

In use, a substantial portion of the stake 31 is inserted in to the ground. This ensures the stability of the emitter stake 30, and makes it easy to maintain the positioning of the emitter skates for directing water to a targeted location. A plurality of emitter stakes are placed in this manner. Then, the side tubes 32A/32B of adjacent emitters stake 30 are connected together by tubing, so that a series of emitter stake are connected into a line by tubing, as schematically shown in FIG. 9C. A water source is connected to the free end of a first water tubing connected to the first emitter stake, and water flows from one emitter stake to the next. At each emitter stake, the water flows from one side tube (e.g. 32A) to the other (e.g. 32B) while an amount of water is diverted to the channel 34B and emitted by the spout 37 of the rotating member 35. The rotating member 35 may be adjusted in similar ways as the rotating members of other embodiments to direct water to desired locations. The short tubes 32A/32B may have a shape that facilitates the retention of the tubing. Optionally, additional tightening means may be used to secure the tubing to the short tubes 32A/32B.

Various embodiments of the invention have been disclosed above. A common characteristic of all of the embodiments is that the drip irrigation device (emitter) is manually adjustable to direct water in any desired direction within a substantial portion of a hemisphere, and maintaining that direction without external support. A manually water directing structure achieves this function. In the embodiments of FIGS. 1-6B and 9A-9B, the water directing structure includes a base having a spherical indentation and a rotating member having an internal channel which can be rotated/twisted/tilted in the base, with water passages inside both components. In the embodiment of FIG. 7A, the water directing structure includes a spherical shaped protrusion and a spout cap having a spherical shaped inside surface which fits over the protrusion, with water passages inside both components. In the embodiment of FIG. 7B, the water directing structure includes a spout cap having a vertical tube which fits in the plunger of the base. In the embodiment of FIGS. 8A and 8B, the water directing structure includes a tubular body that is manually bendable (i.e., by hand without using a tool) and can retain its bent shape without external support. The water directing structure can be rotated, tilted, bent, or otherwise adjusted to target water to a desired location. In all embodiments, the water is supplied from a water inlet into the water directing structure. In the embodiments of FIGS. 1-8B, the inlet is a plunger that can be inserted into a hole in a water pipe. In the embodiment of FIGS. 9A-9C, the inlet is one of the two side tubes.

Another common characteristic of some of the embodiments of the present invention (FIGS. 6A-7B) is that the spout has two or more water outlets that can emit water in two or more directions simultaneously. While two outlets are shown in these figures, the emitter may have three or four outlets, preferably distributed in even directions, to allow better coverage.

While the above description contains many specificities, the reader should not construe these as limitations on the scope of the invention, but merely as examples of preferred embodiments thereof. It will be apparent to those skilled in the art that various modification and variations can be made in the emitter of the present invention without departing from the spirit or scope of the invention. Thus, it is intended that the present invention cover modifications and variations that come within the scope of the appended claims and their equivalents.

What is claimed is:

1. An emitter for a drip irrigation system comprising:

a water inlet in fluid communication with a water supply; and a manually adjustable water directing structure in fluid communication with the water inlet, for directing water in a direction which is adjustable within a substantial portion of a hemisphere, the water directing structure having a spout with at least one water outlet, the water outlet being in fluid communication with the water inlet, wherein the water directing structure comprises:

a base jointed to the water inlet, where an upper portion of the base defines a spherical shaped indentation with a top opening, the top opening being in fluid communication with the water inlet; and a rotating member having a spherical outer shape configured to fit onto the indentation of the base, the rotating member having a bottom opening on its lower portion in fluid communication with the top opening of the base, wherein the spout is joined to an upper portion of the rotating member, the spout having at least one outlet in fluid communication with the bottom opening of the rotating member, wherein the spout is in fluid communication with the water inlet via the base and the rotating member allowing water to flow from the water input to the outlet, wherein the rotating member is manually rotatable allowing the outlet to be oriented in substantially any direction within a hemisphere.

2. The emitter of claim 1, wherein the water directing structure further comprises:

a retainer ring removably attached to the base, the retainer ring having a hollow center through which a portion of the rotating member including the spout protrudes, wherein the rotating member is retained between the base and the retainer ring and is manually rotatable to change its azimuth angle and inclination angle with respect to a rotational axis of the base.

3. The emitter of claim 2, wherein the retainer ring is screwed onto the base or snapped onto the base.

4. The emitter of claim 1, wherein the rotating member defines a central axis which is perpendicular to a plane defined by the bottom opening of the rotating member, and wherein the single outlet is located at a non-zero angle with respect to the center axis.

5. The emitter of claim 4, wherein the non-zero angle is between 10 and 20 degrees.

6. The emitter of claim 1, wherein the spout has a T-shape or Y-shape with two outlets.

7. The emitter of claim 1, wherein the water inlet is a plunger configured to be inserted into a drip irrigation pipe.

8. The emitter of claim 1, further comprising:

a stake with a pointed lower end for inserting into ground; and two side tubes extending from the stake and each for connecting to a water tubing, the two side tubes being in fluid communication with each other, wherein one of the side tubes forms the water inlet, wherein the manually adjustable water directing structure is jointed to an upper end of the stake, and wherein the water directing structure is in fluid communication with the two side tubes through a water passage inside the stake.

9. An emitter for a drip irrigation system comprising:

a water inlet in fluid communication with a water supply; and a manually adjustable water directing structure in fluid communication with the water inlet, for directing water in a direction which is adjustable within a substantial portion of a hemisphere, the water directing structure having a spout with at least one water outlet, the water outlet being in fluid communication with the water inlet, wherein the water directing structure includes a bendable tubular body in fluid communication with the water inlet, the tubular body comprising:

a flexible material forming a tube wall; and a plurality of parallel wires embedded in the flexible material and extending parallel to a direction of the tubular body, wherein the tubular body is manually bendable and retains its bent shape without external support.

10. The emitter of claim 9, wherein the flexible material is rubber or plastic, and wherein the wires are metal wires.

11. An emitter for a drip irrigation system comprising:

a water inlet in fluid communication with a water supply; and a manually adjustable water directing structure in fluid communication with the water inlet for directing water in adjustable directions, the water directing structure having a spout with two or more water outlets in fluid communication with the water inlet, wherein the directions of the two or more outlets are manually adjustable around a rotational axis, wherein the water directing structure comprises:

a base jointed to the water inlet and having a top opening in fluid communication with the water inlet; and a rotating member disposed in contact with the base and is manually rotatable with respect to the base around a rotational axis of the base, the rotating member having a spout defining the two or more water outlets, wherein the base and the rotating member have water passages inside for maintaining a fluid communication between the water inlet and the two or more outlets, wherein the base has an upper portion defining a spherical shaped indentation with a top opening which is in fluid communication with the water inlet, wherein the rotating member has a spherical outer shape configured to fit onto the indentation of the base and is manually rotatable around the rotational axis of the base, the rotating member having a bottom opening on its lower portion in fluid communication with the top opening of the base, and wherein the two or more water outlets are joined to an upper portion of the rotating member and are in fluid communication with the bottom opening of the rotating member.

12. The emitter of claim 11, wherein the water directing structure further comprises:

a retainer ring removably attached to the base, the retainer ring having a hollow center through which a portion of the rotating member including the water outlets protrude, wherein the rotating member is retained between the base and the retainer ring and is manually rotatable around the rotational axis of the base.

13. The emitter of claim 11, wherein the water directing structure includes two water outlets in one line pointing to opposite directions.

14. An emitter for a drip irrigation system comprising:

a stake with a pointed lower end for inserting into ground;

two side tubes extending from the stake and each for connecting to a water tubing, the two side tubes being in fluid communication with each other;

a manually adjustable water directing structure joined to an upper end of the stake, the water directing structure being in fluid communication with the two side tubes through a water passage inside the stake, the water directing structure directing water in a direction which is adjustable within a substantial portion of a hemisphere, the water directing structure having a spout with at least one water outlet which is in fluid communication with the water passage inside the stake.

* * * * *